United States Patent [19]

Salvesen

[11] 4,018,467

[45] Apr. 19, 1977

[54] CARTON CARRIER

[76] Inventor: Harold L. Salvesen, 2127 Grandview S., Oceanside, Calif. 92054

[22] Filed: Oct. 16, 1975

[21] Appl. No.: 622,945

[52] U.S. Cl. ..... 294/31.2; 224/55; 229/52 AL; 229/54 R; 224/45 H

[51] Int. Cl.[2] ..... B65D 71/02

[58] Field of Search ..... 224/45 A, 45 AA, 45 BA, 224/45 F, 45 G, 45 H, 45 N, 45 P, 45 Q, 46 T, 48 C, 48 F, 52, 55, 58; 294/31.2, 34, 63 R, 63 B, 87.2, 87 R, 87 SH, 86; 206/203, 428, 477, 478; 229/52 A, 52 AL, 54 R, 54 E; 150/.5, 44, 50

[56] References Cited

UNITED STATES PATENTS

| | | | |
|---|---|---|---|
| 2,998,181 | 8/1961 | Chasolen | 229/52 AL |
| 3,172,586 | 3/1965 | Lu | 224/55 |
| 3,220,626 | 11/1965 | Tupper | 294/31.2 |
| 3,315,857 | 4/1967 | Eclav | 224/45 H |
| 3,782,619 | 1/1974 | Dittbenner | 229/52 AL |

FOREIGN PATENTS OR APPLICATIONS

| | | | |
|---|---|---|---|
| 1,435,950 | 3/1966 | France | 229/54 R |
| 1,357,541 | 2/1964 | France | 224/55 |

*Primary Examiner*—James B. Marbert
*Attorney, Agent, or Firm*—Jack C. Munro

[57] ABSTRACT

A carton carrying device which includes a flat base upon which is to be placed one or more articles to be carried, such as a carton or cartons, a first transverse strap and a second transverse strap attached to the base and being spaced apart, an elongated handle fixedly attached to the second transverse strap and being removably securable to the first transverse strap.

7 Claims, 4 Drawing Figures

CARTON CARRIER

BACKGROUND OF THE INVENTION

The carrying of any box or carton can be quite cumbersome. The primary reason for this is the fact that the carton does not include any form of a handle. Further, the problem is compounded if there is more than one carton, such as a plurality of small sized cartons and it is difficult, if not totally impossible, to carry a plurality of cartons with only one hand of a person.

Previously, there have been several attempts at designing carton carrying devices. However, in the past, such carton carrying devices have been quite large in size and complex in construction. Frequently, the use of such a carton carrying device is in the area of travel, such as embarking and disembarking from ships, planes and trains. If the carton carrying device itself is large in size and of any appreciable weight, people will frequently avoid the use of the device.

It is an almost absolute requirement that such carton carrying device be composed of few parts and non-complex in construction, inexpensive to manufacture and therefore to purchase, be light in weight, be storable in a very small place in a collapsed position when not in use and also, easily facilitate the location of a carton or cartons thereon and when being carried the cartons are not readily capable of being dislodged from the device.

SUMMARY OF THE INVENTION

The subject matter of this invention is believed to be summarily described in the Abstract Of The Disclosure and reference is to be had thereto. The objectives of this invention are as follows: Composed of few parts and non-complex in construction. Inexpensive to manufacture. Light in weight. Automatically folds to a collapsed position when not in use thereby making such readily storable. Extremely simple to operate. Securely retains all articles that are placed upon the device.

DETAILED DESCRIPTION OF THE SHOWN EMBODIMENT

Figure 1:
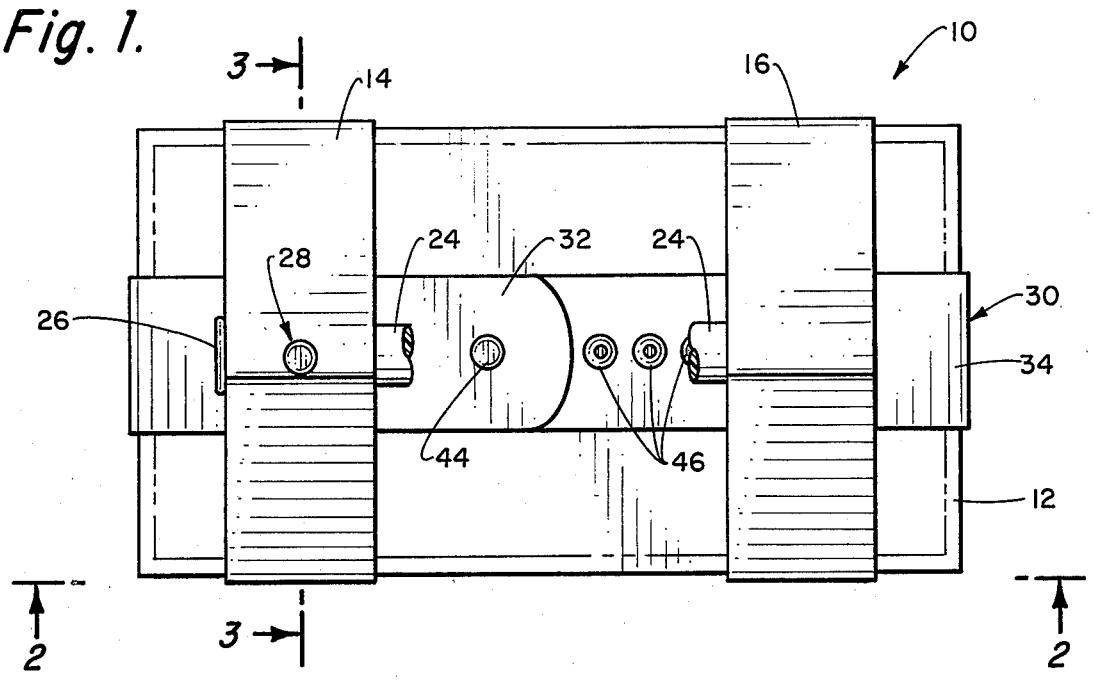
FIG. 1 is a plan view of the carton carrying device of this invention.

Referring particularly to the drawings, there is shown the carton carrier 10 of this invention which is composed primarily of a carton carrying base 12 to which are secured a first transverse strap 14 and a second transverse strap 16. The ends of the straps 14 and 16 are secured to the base 12 by means of elongated side members 18 and 20. The members 18 and 20 are attached to the base 12 by means of screws 22. The base 12 is shown constructed of a wood material which is also true for the members 18 and 20. However, it is understood to be within the scope of this invention that other types of rigid materials could be employed.

The straps 14 and 16 are each of the same length and when extended to a position above the base 12 form an enclosed area. Within this enclosed area is to be contained one or more cartons or other types of articles of material which are placeable upon the base 12. When the carton or cartons or articles are placed upon the base 12, the straps 14 and 16 function to laterally restrain the articles placed upon the base 12 and prevent disassociation from the base 12.

When the strap 16 is in the stretched extended position above the base 12, at the point that the apex of the stretched position the strap 16 is fixedly secured by adhesive or other types of fastening means to a handle 24. The handle 24 is in the form of a cylindrical shaped rod. The handle 24 is also shown to be constructed of a wood material. However, other rigid types of material could be employed.

The strap 16 is secured to the handle 24 at one end thereof. At the opposite end thereof the handle 24 is capable of cooperating with the strap 14. At this end of the handle 24 is located an enlarged annular protuberance 26. The protuberance 26 functions as a lip so that when the strap 14 is placed upon the handle 24 that movement of the strap 14 in a longitudinal direction tending to become disassociated from the handle 24 is prevented. However, it may be desirable to employ a locking means such as the snap assembly 28 to secure the strap 14 to the handle 24 when placed thereon. However, the snap assembly 28 permits removal of the strap 14 from the handle 24. The snap assembly 28 is deemed to be a conventional form of snap which includes a headed fastener with the protuberance thereon which cooperates within an opening formed in the handle 24.

It may be desirable to longitudinally restrain any cartons placed upon the base 12. This is accomplished by the use of a longitudinal strap assembly 30 which is composed of a first longitudinal strap 32 and a second longitudinal strap 34. The strap 32 is secured to the underside of the base 12 by means of an end member 36 and screw fastener 38. In a similar manner, the strap 34 is attached to the underside of the base 12 by means of end member 40 and screw 42. The strap 32 is connectable to the strap 34 by means of a snap 44 which is connectable with any one of a plurality of recesses 46. The use of the plurality of recesses 46 is to provide adjustment of the location of the longitudinal strap assembly 30 about the cartons.

Figure 2:
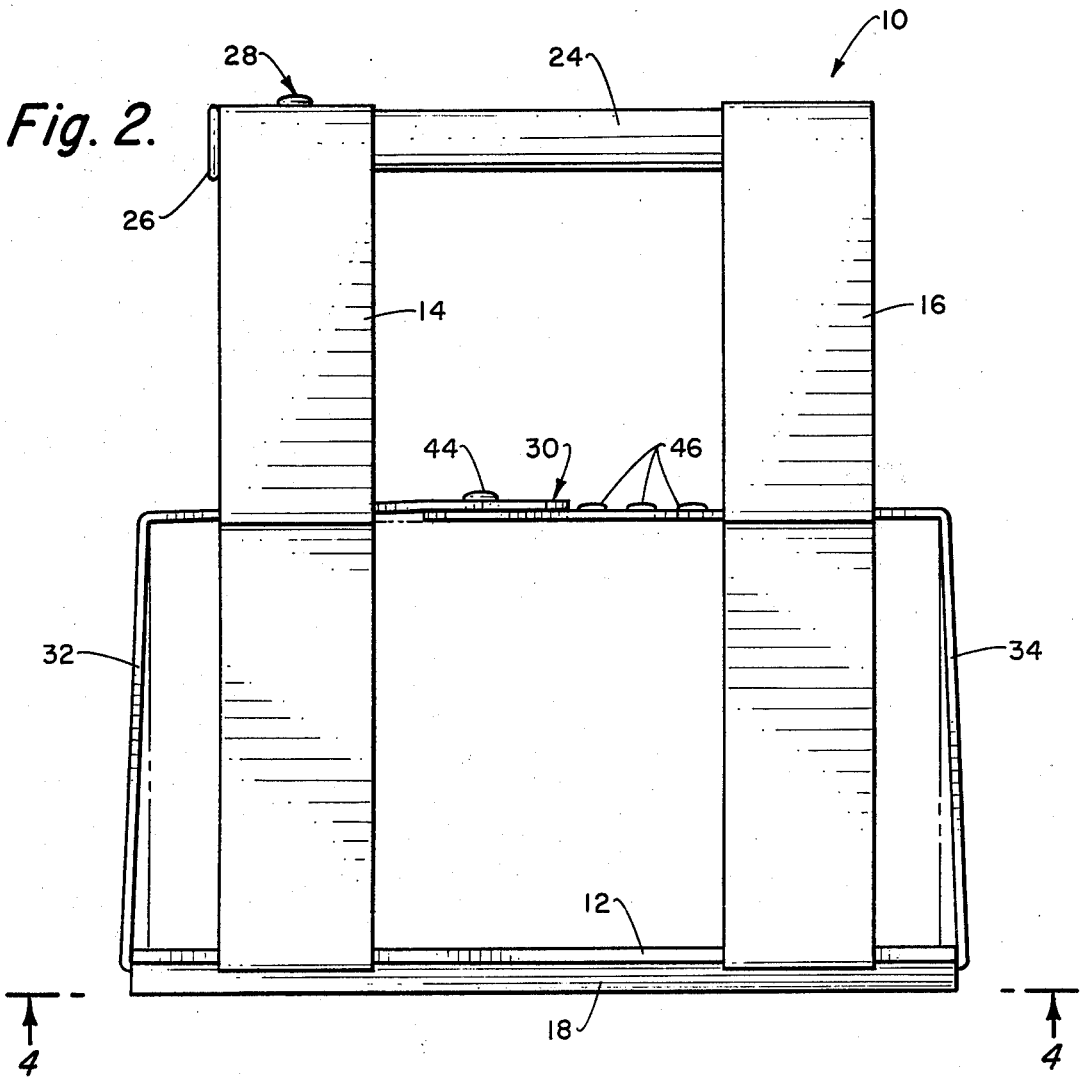
FIG. 2 is a side view of the carton carrier of this invention taken along line 2—2 of FIG. 1.
Figure 3:
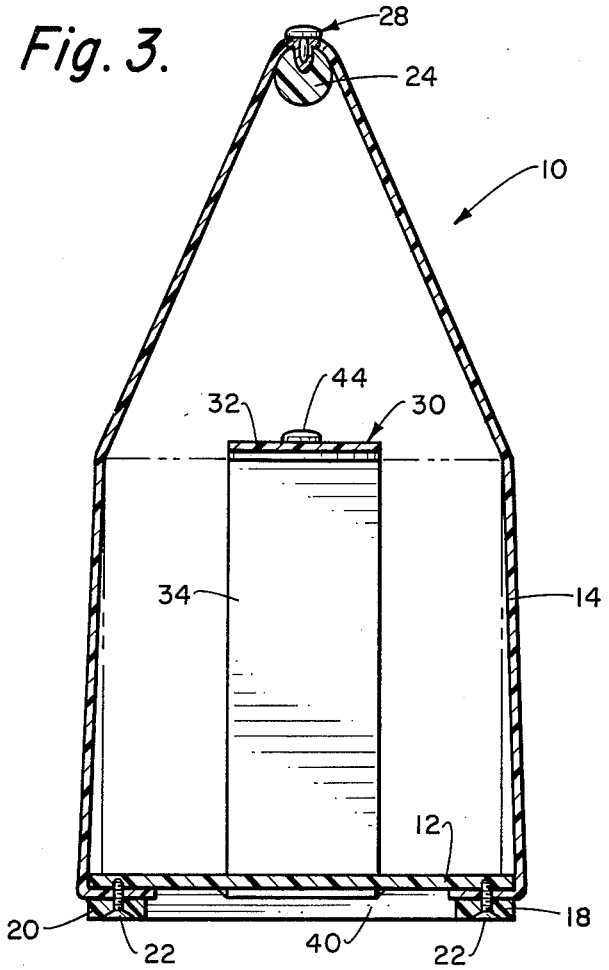
FIG. 3 is a cross-sectional view taken along line 3—3 of FIG. 1.
Figure 4:
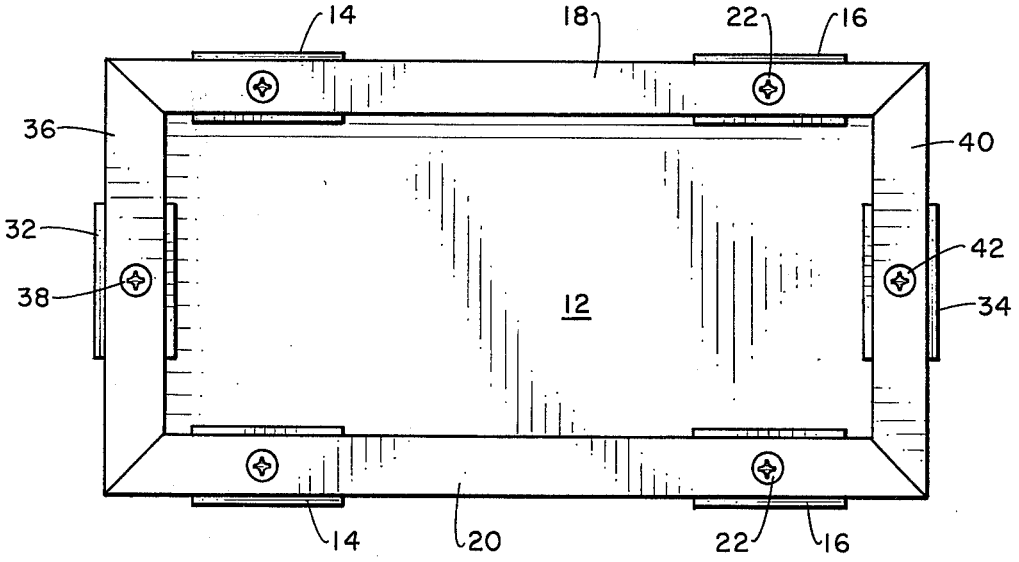
FIG. 4 is a bottom view of the carton carrier of this invention taken along line 4—4 of FIG. 2.

The operation of the carton carrier of this invention is as follows: The strap 32 is disconnected from the strap 34 and these straps are not positioned upon the base 12. The strap 14 is disconnected from the handle 24 with the strap 14 then moved adjacent one end of the base 12 and the strap 16 is then moved adjacent the other end of the base 12. The carton or cartons or other articles to be placed upon the base 12 are then placed thereupon. The strap 32 is then connected to the strap 34. The operator then grasps the handle 24 and moves such to the position shown in FIG. 2 at which time the strap 14 is then placed upon the handle 24. If the snap assembly 28 is employed it is then securely locked to the handle 24. The carton carrier is then ready to be employed by the person grasping the handle 24 in the space between the straps 14 and 16 and then effect moving or carrying of the devices placed upon the base 12. It is to be understood that within the structure of this invention the longitudinal strap assembly 30 may or may not be employed as well as also the snap assembly 28 may or may not be employed.

I claim:

1. A carton carrier comprising:

a base, said base adapted to receive thereon at least one carton;

a first transverse strap attached to said base and enclosing a first enclosed area;

a second transverse strap attached to said base and enclosing a second enclosed area, said second transverse strap being spaced from said first transverse strap forming a space;

an elongated handle having a first end and a second end, said second end of said handle being fixedly secured to said second transverse strap, said first end of said handle detachably connectable with said first strap with said first strap being capable of being removed from association with said first end of said handle, with one or more cartons located upon said base, said first and second transverse straps are locatable on each side of the carton to laterally restrain the carton, and with the first transverse strap located upon and in frictional engagement with the first end of said handle, a person's hand is to grasp the handle in the space between the first and second transverse straps and thereby carry the carton.

2. The carton carrier as defined in claim 1 wherein: the length of said first transverse strap being equal in length to said second transverse strap.

3. The carton carrier as defined in claim 2 wherein: said first end of said handle terminating in a strap retaining member, whereby with said first strap placed upon said first end said first strap is prevented from moving longitudinally with respect to said handle and thereby become disconnected from said handle.

4. The carton carrier as defined in claim 3 wherein: said strap retaining member comprises an enlarged protuberance extending outward from the cross-sectional periphery of said handle.

5. The carton carrier as defined in claim 4 including: locking means interconnecting said first end of said handle and said first strap, said locking means functioning to fixedly position said first strap when placed upon said handle but yet permitting disassociation of said first strap with respect to said handle.

6. The carton carrier as defined in claim 5 wherein: said handle comprising an elongated rod.

7. The carton carrier as defined in claim 6 including: a longitudinal strap assembly connected to said base, said longitudinal strap assembly adapted to extend longitudinally over the carton supported upon said base, whereby said longitudinal strap assembly being adapted to prevent longitudinal movement of any cartons placed upon said base.

* * * * *